US006251339B1

(12) United States Patent
Beane et al.

(10) Patent No.: US 6,251,339 B1
(45) Date of Patent: Jun. 26, 2001

(54) METHOD FOR MAKING PARTS FROM PARTICULATE FERROUS MATERIAL

(75) Inventors: Glenn L. Beane, Hanover; David S. Lashmore, Lebanon; Lev Deresh, Plainfield, all of NH (US)

(73) Assignee: Materials Innovation, Inc., W. Lebanon, NH (US)

( * ) Notice: Subject to any disclaimer, the term of this patent is extended or adjusted under 35 U.S.C. 154(b) by 0 days.

(21) Appl. No.: 09/381,552

(22) Filed: Sep. 28, 1999

Related U.S. Application Data

(60) Provisional application No. 60/041,477, filed on Mar. 24, 1997.

(51) Int. Cl.[7] ..... B22F 1/02
(52) U.S. Cl. ..... 419/35; 419/38; 419/46
(58) Field of Search ..... 419/35, 38, 46

(56) References Cited

U.S. PATENT DOCUMENTS

| | | | | |
|---|---|---|---|---|
| 4,151,435 | | 4/1979 | Jandeska et al. . | |
| 4,601,765 | | 7/1986 | Soileau et al. . | |
| 4,954,171 | | 9/1990 | Takajo et al. . | |
| 5,211,896 | | 5/1993 | Ward et al. . | |
| 5,318,746 | | 6/1994 | Lashmore et al. . | |
| 5,352,522 | | 10/1994 | Kugimiya et al. . | |
| 5,466,311 | | 11/1995 | Hu et al. . | |
| 5,531,955 | | 7/1996 | Sugikawa . | |
| 5,603,815 | * | 2/1997 | Lashmore et al. | 204/222 |
| 5,711,866 | | 1/1998 | Lashmore et al. . | |
| 6,024,915 | * | 2/2000 | Kume et al. | 419/48 |

* cited by examiner

*Primary Examiner*—Daniel J. Jenkins
(74) *Attorney, Agent, or Firm*—Fran S. Wasserman

(57) ABSTRACT

The invention is directed to a method of forming parts having complex geometries made by coating ferrous based powders with a metallurgical coating, pressing the powder to make the parts, and using a low temperature heating step to diffuse the coating into the ferrous based powders.

13 Claims, 8 Drawing Sheets

METHOD FOR MAKING PARTS FROM PARTICULATE FERROUS MATERIAL

This application claims benefit to provisional Application 60/041,477 Mar. 24, 1997.

FIELD OF THE INVENTION

This invention relates to making parts from particulate ferrous materials such as iron and steel powders. More particularly, the invention relates to making ferrous parts as well as parts from other alloy materials that have improved physical properties, such as increased green density and increased strength. The invention is also directed to a method by which parts having complex geometries can be made and properties of these parts can be improved by coating ferrous based powders with a metallurgical coating, pressing the powder to make the parts and using a low temperature heating step. The invention further relates to materials and parts used in, or produced by the aforementioned methods such as alloy materials heretofore unavailable by powder metallurgy.

BACKGROUND OF THE INVENTION

Powder metallurgy, i.e., pressing powdered metals in die presses to make parts, is used by a variety of industries as an inexpensive source of parts. Ferrous metal (e.g. iron and steel) parts that are made using present powder metallurgy techniques are however, generally much less than 100% theoretical density at the point they are taken off the powder press ("green" density). For example, typical densities obtained when iron parts are pressed using known methodology can range from 6.4 g/cc to about 7.4 g/cc. In contrast, a fully dense (100% theoretical density) iron part should have a density about 7.8 g/cc.

Many applications for sintered ferrous compacts require higher densities. One reason for this is that a number of properties such as Young's modulus, electromagnetic characteristics and Poission's ratio improves with increased density. A factor contributing to the difficulty in obtaining fully dense ferrous parts using presently available powder metallurgy methods is that particulate ferrous materials "work harden" (although pure iron is generally a ductile material). Additionally, when ferrous powders are pressed, the naturally occurring oxides on the surfaces of the powders to some extent are scraped away and point to point welding occurs between the powders before the part can be pressed to full density and final shape. This density is always less than 100% theoretical. As a result, a much increased energy expenditure is necessary to overcome the results of work hardening and to break the particle to particle bonds, alleviate die wall friction and process the part further. In prior art methods, the powders are lubricated with an organic lubricant prior to pressing as a way to minimize this point to point welding, both powder to powder, and powder to die wall. Typical prior art lubricants include a number of organic compounds such as zinc stearate or waxes. An example of such a lubricant, a polyether lubricant, is taught in U.S. Pat. No. 5,498,276 to Luk. Although the lubrication generally decreases the work expenditure necessary to press the ferrous powders into parts, these parts can also be precluded from being pressed to full density because some degree of internal interconnected porosity must be maintained in the part in order to permit transport of the decomposition products of the organic lubricant inside the part to the outside when it is exposed to elevated temperatures and reducing atmospheres for this purpose. Thus, the resulting green density of such "lubed" parts is generally about 6.3 to about 7.0 g/cm$^3$. During the "delubing" process, the lubricant is expected to volatize and diffuse out of all portions of the part. This complete volatilization does not however, always occur. The part is then exposed to typical sintering temperatures (about or higher than 0.8 of the melting temperature of the material) in a reducing atmosphere such as dissociated ammonia or hydrogen in order to collapse the porosity. Since the internal lubricants are rarely completely removed, the part is subsequently not completely sintered. Therefore, defects in the parts are common. Additionally, since some of the lubricant remains in the internal porosity of the part overall, properties of the part are degraded.

In addition, complex part shapes such as class 9 and 10 helical gears, other high precision gears, and sprockets with tight dimensional tolerances cannot, in general, be made by powder metallurgy using present techniques because the required high temperature sintering step (to increase the density of the part) distorts the part from its original shape and thus makes it commercially useless. Such complex parts are therefore individually machined using expensive techniques. Thus, there exists a need for methods by which fully dense parts can be made from powdered ferrous materials using less expensive powder metallurgy techniques and for methods by which fully dense parts can be made without using high temperature sintering to avoid distorting the shape of the pressed parts.

Since pure iron is not a generally strong material, in order to increase the strength of parts made from ferrous powders, the methods commonly known as premixing and prealloying are used. Premixing is a method of homogeneously mixing an iron powder with a metal or metalloid powder or an alloy powder, compacting them and subsequently sintering the compact under heat to solid-solubilized these added metals and in some cases added carbon or phosphorus-containing compounds. This method is less than ideal because the added metal powder in the iron powder causes separation or segregation due to the difference between the respective specific gravities and particle shapes of the iron powder and the additive powder(s). This then leads to a problem of part quality by causing wide variability in the strength and the size of the sintered product. U.S. Pat. No. 4,323,395 to Li attempts to address this segregation problem by dipping base metal particles into chemical solutions of "alloying elements" to cover the surface of the particles with these alloying elements. Since this process involves using soluble compounds of the alloying elements for dipping, the resultant coating is not a true metallurgical coating and introduces amounts of contaminants into the compacted part vis-à-vis the chemical compounds (e.g., the anions). Hence, this process is less than ideal for producing high quality parts.

Prealloying involves using an alloyed steel powder in which alloying elements such as nickel, carbon, copper, molybdenum and chromium are solid-solubilized into the iron before compaction. This method is used to avoid the separation problems of premixing. U.S. Pat. No. 5,240,742 to Johnson et al. provides a variation of such a prealloying method. In Johnson et al., iron powders are dipped into a "sol" or solution of chemical precursors of nickel, copper and molybdenum to provide a layer of these compounds on the surface of the powders. The dipped powders are then subjected to a heat and/or reducing treatment to convert the chemical precursors of the metals on the surface of the powders into the metal oxides and to form at least a partially alloyed layer on the surface of the powders. These partially alloyed powders are then compacted and the compacts are subjected to high temperature sintering. This process does however, have its disadvantages. Namely, since the alloyed steel powder obtained by such prealloying processes is relatively hard when compared with pure iron powder, compaction density cannot be increased sufficiently during compaction making it difficult to obtain a green product of high density, hence the subsequent requirement of high temperature sintering. Accordingly, in prealloying processes such as that of Johnson et al., full advantage of the superior physical properties of alloyed steel cannot be taken. Additionally, the chemical precursors of Johnson et al. have the potential to introduce contaminants into the finished pressed part. High temperature sintering also makes the powders and method of Johnson et al. particularly unsuitable for making parts of complex geometry and tight dimensional control.

Thus there further exists a need for a method by which the density, strength and other properties of pressed iron (or ferrous based) parts can be increased which overcomes the disadvantages (as for example, decreased density, introduction of contaminants) of the aforementioned methods.

SUMMARY OF THE INVENTION

It is therefore an object of the present invention to provide a method for making parts from particulates of ferrous material and other materials that, inter alia, overcomes the aforementioned disadvantages. For purposes of this invention "ferrous" is intended to include all iron materials including alloys of iron as well as pure iron and all steels. The present invention provides a method for increasing the green density of parts made by pressing powders of materials, such as ferrous materials, that work harden rapidly, are hard themselves, and/or point to point "weld" upon compaction. Furthermore, since the present invention provides a process that does not require a high temperature sintering step, it can readily be used to make parts having complex geometries and tight dimensional tolerances.

In a preferred embodiment, the present invention comprises providing a quantity of particulates of a material that welds upon compaction, such as a ferrous material or materials that are themselves hard, as for example steel; electrochemically depositing a layer of from about greater than 0 wt % to about 50 wt %, and preferably less than about 2 wt %, of ductile metal or alloy onto each of said particulates. The metal acts as a lubricant and/or acts to eliminate welding of particle to particle and particle to die wall. The thus plated or coated particulates are then consolidated under pressure to form a part, and the part is heated. Such heating step is preferably carried out in a reducing atmosphere, at a temperature of from about 200° C. to about 800° C., and most preferably about 400° C. for a period of from about 1 to about 10 hours. In general this heating step is conducted at a temperature which is from about 30% to about 80% of traditional high temperature sintering temperatures. By using such relatively low temperatures in the heating step and by starting with a higher density material, the consolidated part is not distorted in shape as it would be by traditional high temperature sintering.

Thus, the present invention solves the shape distortion problems associated with high temperature sintering of powder metallurgy parts by providing a process whereby pressed parts can be heated at relatively low temperatures because a) the substantially uniform metallurgical coatings on the iron particles provide lubricity and therefore allow the parts to be pressed to higher than traditional green densities, thus higher temperatures are not needed to collapse internal porosity in the green part and increase its density and b) the uniform coatings around each particle allow for shorter diffusion distances between the metal coating material and the core particle thus eliminating the need for higher temperatures to promote homogeneity in the finished part.

Moreover, the present invention provides a process which enables the formation of alloys and intermetallics by powder metallurgy that were heretofore unavailable suing traditional powder metallurgy methods. This is due to the fact that when alloys or intermetallics are formed by using blended powders, the powder particles are only in point to point contact with each other. In the present process the core particle is completely surrounded with the alloying material thereby further contributing to overall homogeneity of the resultant alloy material. In the present process, the pressed part is heated for a period of time that is selected to avoid the formation of intermetallics between the iron (ferrous) or steel core particle and the metal coating and just long enough to promote diffusion of the coating material into the core. Alternatively, for some alloys, intermetallic formation may be desirable. Thus, the process enables alloys to be formed rapidly and in some cases safely which would ordinarily be difficult to produce by powder metallurgy as for example TiNi, and M2, M4 and S7 steels.

DETAILED DESCRIPTION OF THE PREFERRED EMBODIMENTS

Figure 1:
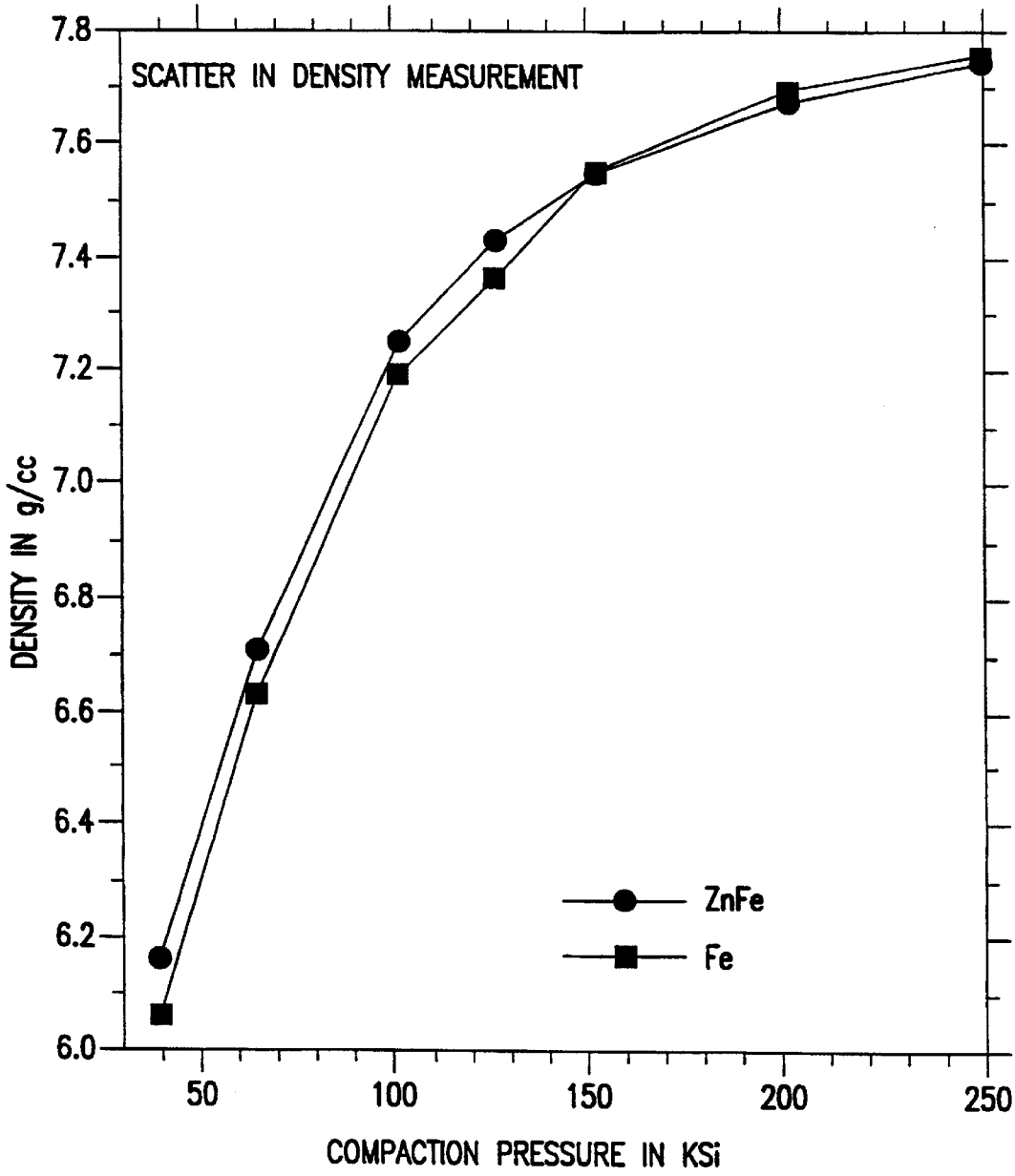
FIG. 1 is a graph showing density as a function of pressure over time for parts pressed from pure iron powder (■) and from zinc coated iron powder (●) in a process according to the present invention.
Figure 2:
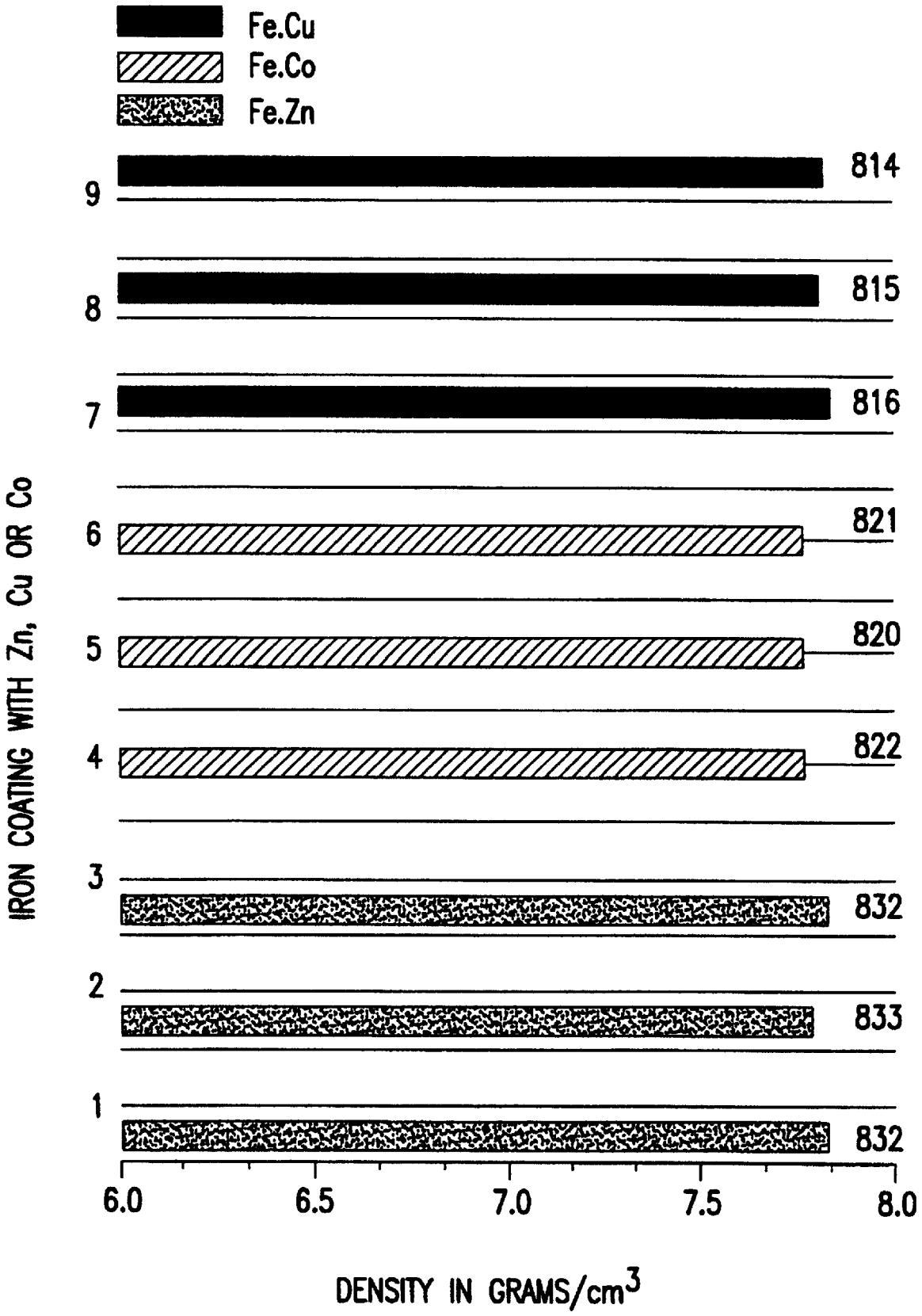
FIG. 2 is a bar graph comparing the densities of parts pressed according to the present invention and from zinc coated, cobalt coated and copper coated iron powders, respectively.

In a first embodiment the present invention is directed to a method for making a part or parts from particulates of ferrous material. As a first step, a substantially uniform metallurgical layer of from greater than about 0 wt. % to about 50 wt. %, (and for some applications, e.g., lubrication, this may be less than 2 wt. %) of ductile metal or alloy is electrochemically deposited onto each of said particulates. For purposes of this invention, "particulates" should be interpreted to include powders, whiskers, fibers, continuous wires, sheets and foils. Suitable ferrous materials for use in this process, include, but are not limited to, iron, steels, stainless steels, as for example, but not limited to M2 (0.85C, 0.34Mn, 0.30Si, 4.0Cr, 2.0V, 6.0W, 5.0Mo), M4 (1.30C, 0.30Mn, 0.30Si, 4.0Cr, 4.0V, 5.5W, 4.5Mo), S7 (0.5C, 1.4Mo, 3.25Cr) and 52100 steel alloys.

The coating can be done by any method known in the art for providing uniform metallurgical coatings on metal powders. Preferably, the coating step is done by electrochemical deposition and most preferably by electroplating to ensure as uniform a layer of the metal material on the particulate ferrous material as possible. The only requirement for the metal coating is that it be a true metallurgical coating. Hence, any known coating process (e.g., sputtering, CVD or chemical reduction) or electroplating process can be used to coat the particles in this invention. A particularly preferred process for plating the layer of ductile metal or alloy onto the particulates is one using the Fluidized bed apparatus taught in U.S. Pat. No. 5,603,815 to Lashmore et al. hereby incorporated in its entirety by reference herein.

The aforementioned process comprises combining particles of a particulate substrate material and an electrolyte in an imperforate container; vibrating the container to generate a fluidized bed of the particles in the electrolyte and electrochemically depositing a coating on the particles from the reactants in the electrolyte. The container should preferably be electrically conductive and the process should be an electrolytic method which includes applying an electric current (direct or pulsed) through the electrolyte concurrent with the existence of the fluidized bed of particles. As an example only, nickel can be deposited from a sulfamate, sulfate, citrate or acetate electrolyte in the fluidized bed onto commercially available pure iron powder (Hoeganaes 1000C Fe particles of sizes ranging from about 20$\mu$ to about 150$\mu$). Zinc is preferably deposited from a cyanide or ammonia electrolyte, copper is preferably deposited from a pyrophosphate or cyanide electrolyte and cobalt is preferably deposited from a sulfate or sulfamate electrolyte.

Preferred materials for use as the ductile plating metal or alloy, include, but are not limited to zinc, tin alloys (preferably zinc-tin alloys such as tin75zinc25 or compositions such as tin30zinc70 to tin70zinc30) cobalt, nickel, antimony, copper, cadmium, platinum, ruthenium, tin, gallium, palladium, and rhenium. Particularly preferred materials for use in this embodiment are cobalt, tin-zinc alloys, nickel and copper. The coating should preferably be from greater than about 0 wt % to about 50 wt %, and more preferably of greater than about 1% to about 20% of the total weight of the coated powder.

Generally, any known ductile materials are appropriate for use in this invention. The appropriate coating material should be chosen for its ability to "lubricate" the ferrous particulates during consolidation. An example of an especially lubricating metal is zinc and an equally lubricating alloy is tin75zinc25. For the purposes of this invention, "lubricate" is intended to mean to impart to the particles an ability to slip and slide by each other during consolidation, thereby minimizing or eliminating point to point welding of the powders during the initial stages of the compaction process and maximizing the density of the resultant green pressed part. The coating material should also be chosen for its ability to solubilize into the core particulate material upon being heated.

Figure 3A:
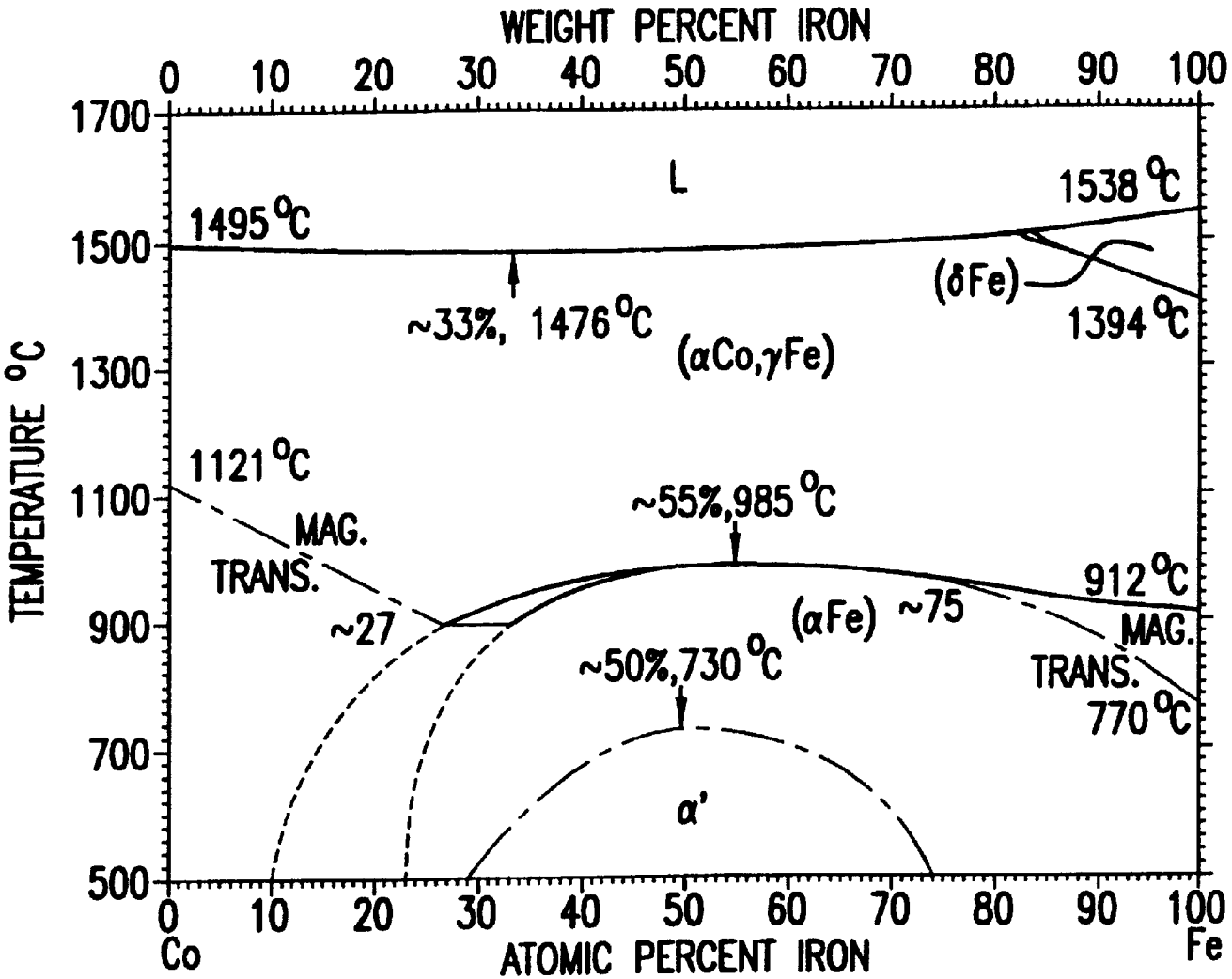
FIGS. 3*a* and 3*b* are phase diagrams showing the solubility of cobalt coatings in iron to be about 10% by weight at a temperature of about 500° C.
Figure 3B:
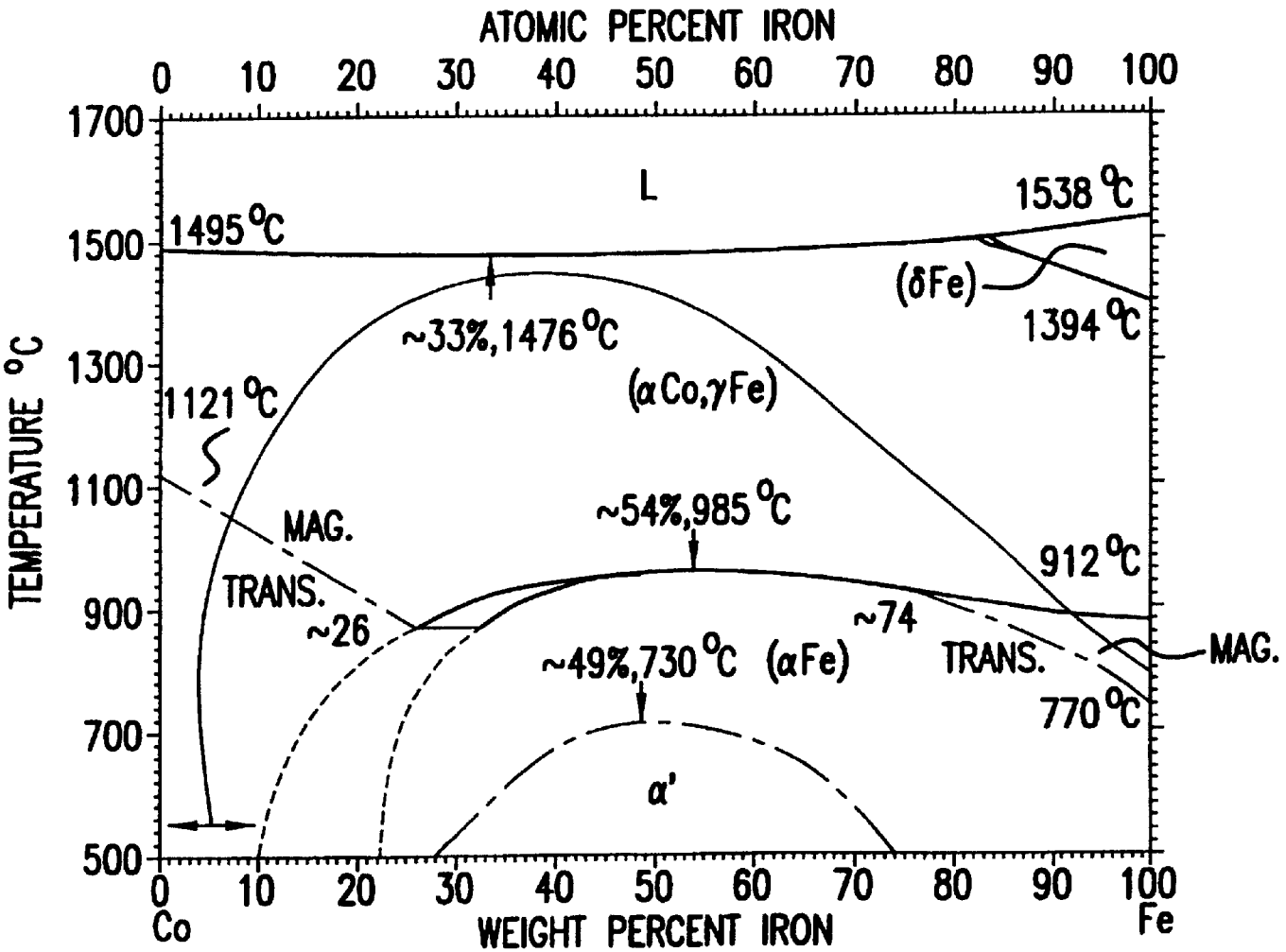
Figure 4A:
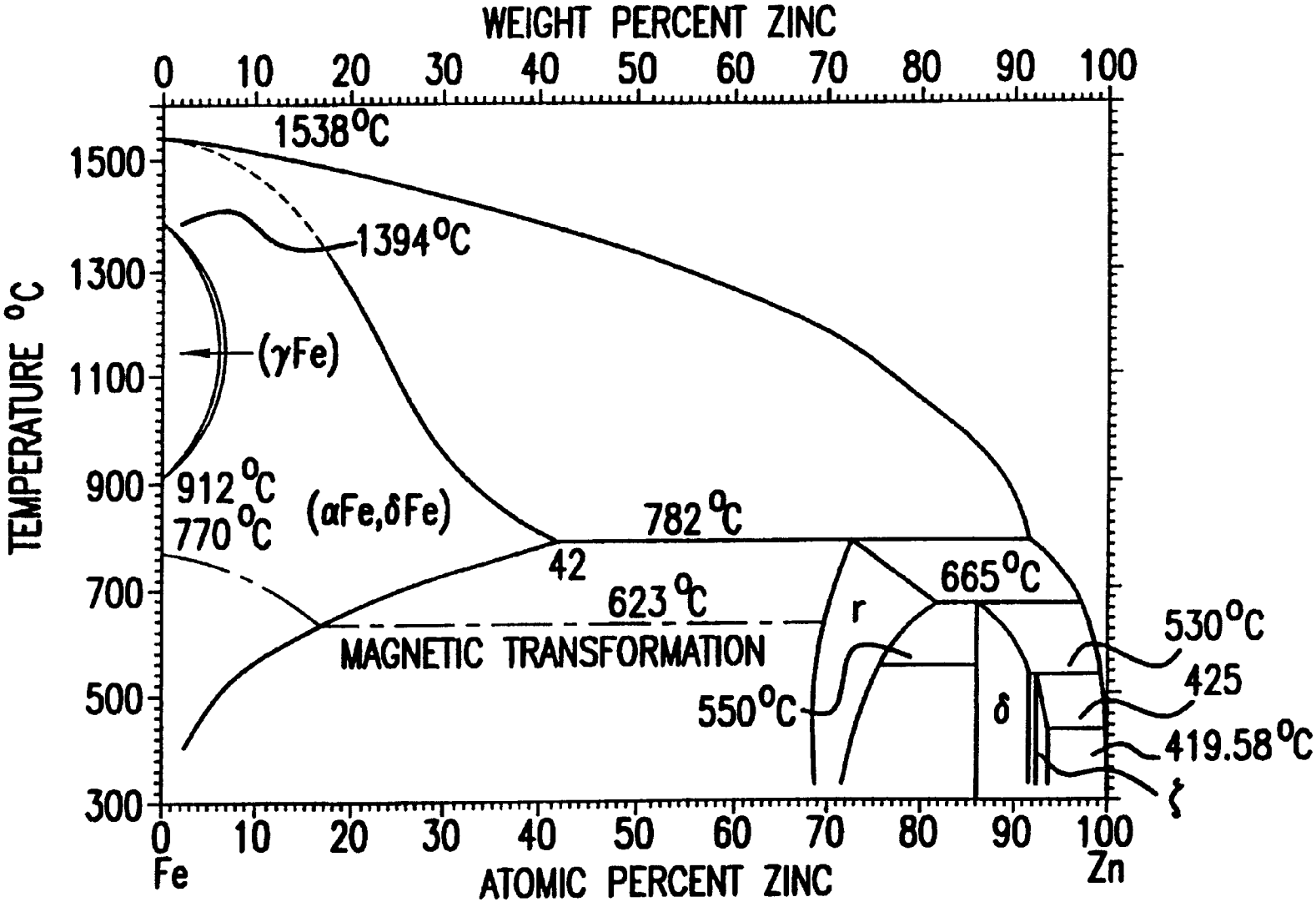
FIGS. 4*a* and 4*b* are phase diagrams showing the solubility of zinc coatings in iron to be about 7% by weight at a temperature of about 425° C. after first being heated to a temperature around 420° C.
Figure 4B:
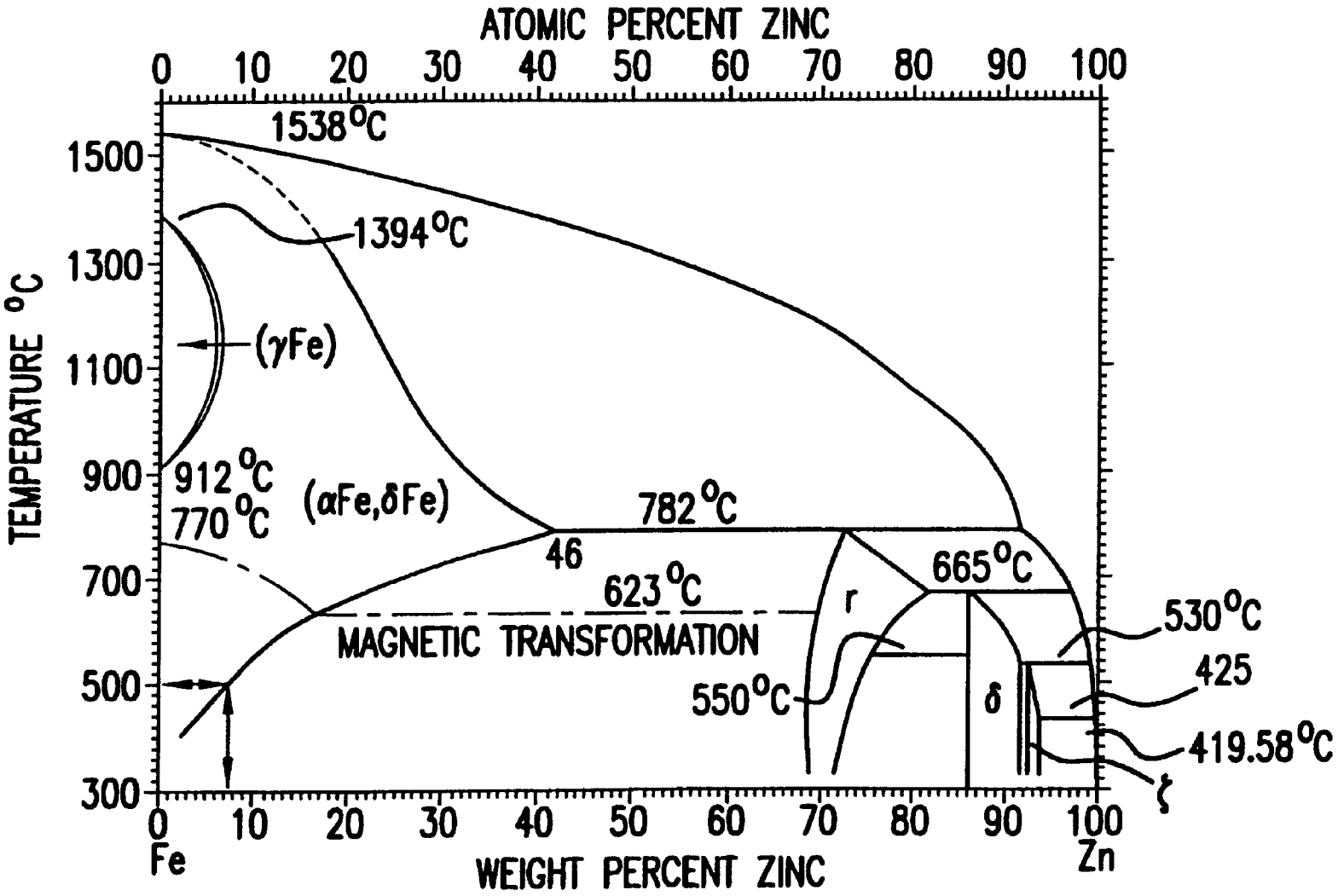
Figure 5A:
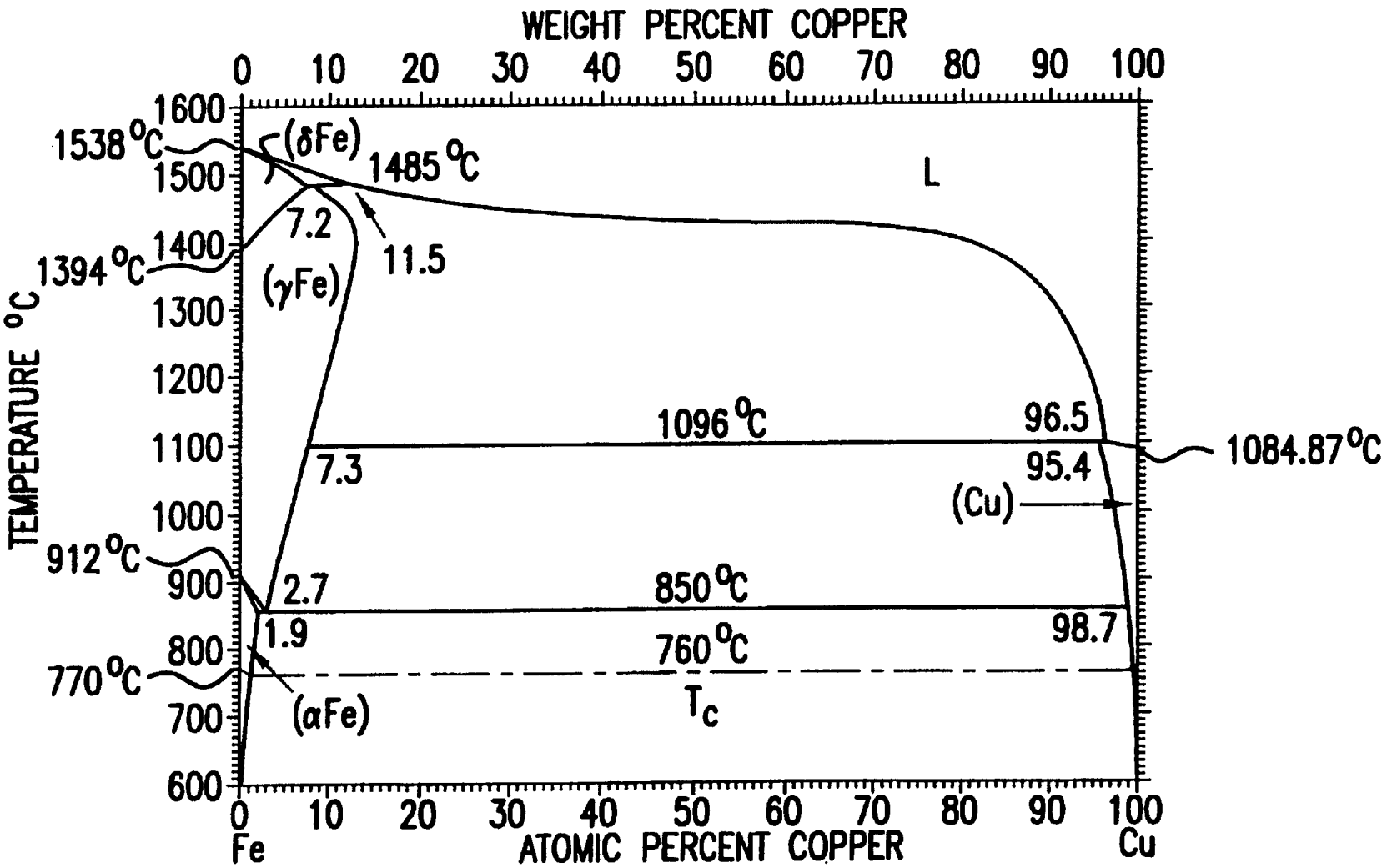
FIGS. 5*a* and 5*b* are phase diagrams showing the solubility of copper coatings in iron to be relatively small even at temperatures of about 600° C.
Figure 5B:
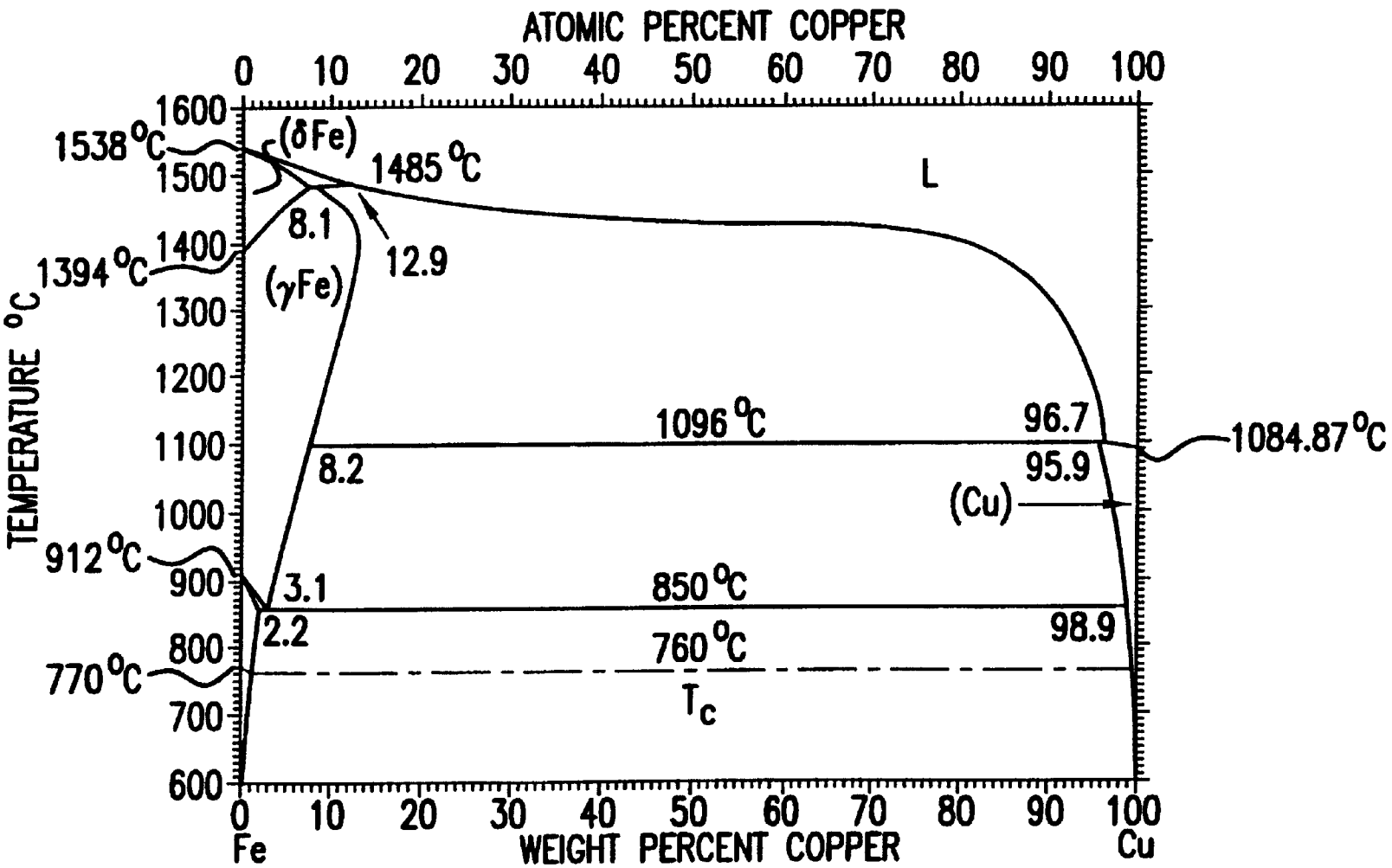

In this regard reference is made to FIGS. 3*a* and *b* which are phase diagrams showing the solubility of cobalt coatings in iron to be about 10% at an annealing temperature of about 500° C. FIGS. 4*a* and *b* are phase diagrams showing the solubility of zinc coatings in iron to be about 7% at an annealing temperature of about 425° C. It should be noted that zinc always forms some type of intermetallic phase with the iron at the particle coating interfaces. FIGS. 5*a* and *b* show the solubility of copper coatings in iron to be relatively small even at an annealing temperature of about 600° C. FIGS. 6*a* and 6*b* are phase diagrams showing the solubility of nickel coatings in iron to be about 2% by weight at a temperature of 200° C. and 4.9% at a temperature of 347° C. Continuous coatings imparting lubricity at weight percents less than these are readily achieved. Even though some of these coatings can impact mechanical properties, even at these low concentrations the use of coated powders enables dense powder metal alloys to be produced which could not otherwise be achieved without the coatings.

Additionally, the coating material can be chosen for its properties, such as mechanical, tensile, strength, etc. By coating the iron (or steel) particles with materials that have other desirable properties, the present invention can be used to engineer or improve properties of parts made from iron (or steel) powders in addition to increasing green density. Cobalt, nickel, copper, titanium, and zinc and are generally chosen for their ability to solubilize into the core material and to impart superior mechanical properties to the final part.

As an example of a preferred particulate and coating material for use in this embodiment, the particulate can be steel (for strength) and the coating material can be cobalt (for lubricity and mechanical properties). Hence, in such an instance, the present process can provide for the production of a fully dense green part having both the superior tensile strength of steel and the superior mechanical properties of cobalt. One of skill in the art can envision any number of appropriate combinations for particulate and coating materials and their respective properties and the present process should therefore not be construed to be limited to selecting materials for strength and mechanical properties only or limited to ferrous metals or in fact metals at all. Metallic coated ceramics should also be within the purview of the present invention. The degree to which the finished part will exhibit one or both of the respective properties will depend on the relative thickness of the coating material on the particulate.

Once coated, the particulates are consolidated to form a part and the part is heated at a temperature of from about 200° C. to about 800° C., for a period of from about 10 minutes to about 10 hours. Preferably, the temperature is from about 300° C. to about 550° C. and the time period is from about 20 minutes to about 180 minutes. In this process, the appropriate temperatures and times for this heating step should in general be selected to be high enough to cause the coating material to diffuse into the core (particulate) material, while being low enough to prevent the formation of an intermetallic phase or phases between the particulate material and its coating. Hence, the appropriate temperatures should be selected depending on the relative thickness of the coating materials and the materials themselves. For example, tin-zinc coated ferrous materials should preferably be heated at a temperature of about 175° C. for about 6 hours, nickel coated ferrous materials should preferably be heated at a temperature of about 350° C. for a time period of about 30 to 120 minutes, cobalt coated materials at a temperature of from about 500° C. to about 800° C., preferably about 700° C. and copper coated materials should preferably be heated at a temperature of from about 700° C. to about 750° C. for a time period of about 30 to 120 minutes.

The coated particles are compacted to a density approximating "full or theoretical density" (the density at which the compacted coated particles have at least non-interconnected porosity). Hence, the green density of this coated particle compact (and its shape) would only moderately be increased if the compacted product were subjected to traditional high temperature sintering.

Although any source of pressure is suitable to consolidate or compact the powders, the consolidation step is preferably done in the die cavity of a powder press. Such powder pressing methods are known in the art of powder metallurgy. However, any method wherein adequate pressure to form a cohesive part (or cause the coated particulates to adhere to each other) can be applied, is or are suitable for use in the present invention. In general, the appropriate pressures to adequately consolidate these coated particles to a "fully" (100% theoretical density) dense green part should preferably be from about 60 Ksi to about 200 Ksi when pressing is done on a traditional powder press with or without a heated die. Additionally, consolidation can be effected by high velocity projection (similar to thermal spraying), roll-bonding, "HIP"ing, "CIP"ing, forging, powder extruding, coining or rolling the coated powders or high velocity spraying cold with activation solutions.

This process can also be used to make fully dense green parts wherein particulates of cobalt and nickel based materials are used in place of the particulates of ferrous material. In such instances, the process parameters are substantially the same as those for ferrous based particulates.

Hence, this invention is particularly suited to increasing the density of parts made by pressing powders of materials that work harden rapidly, or point to point weld during consolidation i.e., iron or are already hard, i.e., steel. The present invention method is also particularly suited for making ferrous and other metal parts having complex geometries by powder metallurgy, since high temperature sintering is not required. An example of such a metal part, is a helical gear or sprocket. Such parts are traditionally machined to avoid shape distortion due to high temperature sintering.

The invention further provides an embodiment in which the properties of an iron or steel part made by powder metallurgy are engineered. In this embodiment a quantity of particulates of a first iron or steel material is provided. The first material is coated by plating a layer of from about 2 wt. % to about 10 wt % of a second material thereon. The coated particulates are consolidated to form a part and the part is heated at a temperature of from about 350° C. to about 400° C. for a period of time of about 120 minutes. In this embodiment, the temperature and time is selected to promote the solubilization of the coating material into the core ferrous material.

This embodiment can include more specific applications of the methods described herein. Specifically, this embodiment also can be used to produce hard parts by pressing (on powder metallurgy presses) traditionally soft materials that have been uniformly coated with zinc or tin-zinc alloys. The pressed, coated material is then subjected to heat treatment, which serves to diffuse the coatings into the iron or steel.

Additionally, this embodiment can be directed to a method for producing a steel or iron part having a case hardened surface. In this method, a quantity of soft annealed iron particles are provided with a metallurgical coating of chromium or molybdenum and the particles are consolidated to form a part as for example a helical gear. The part is heated at a temperature of from about 400° C. to about 600° C. for a period of time from about 120 minutes to about 500 minutes in order to form a chromium or molybdenum rich surface. The part is then exposed to an elevated temperature of from about 700° C. to about 1400° C. for a period of from about 1 hour to about 4 hours. The exposing step is preferably done in a carbon gas atmosphere. The case (outer surface) of the part is hardened when the part is quenched in oil.

As another alternative example, in this embodiment the particulate material can be aluminum (instead of iron or steel), and the second coating material can be nickel or nickel boron. In such an instance, the temperature and time period for low temperature sintering should preferably be from about 200° C. to about 450° C. for a time period of from about 60 minutes to about 300 minutes to produce the nickel aluminide intermetallic (B2(NiAl) or $L1_2(Ni_3Al)$ throughout. Although this intermetallic is a somewhat brittle alloy, it exhibits superior temperature corrosion behavior and good mechanical properties at high temperatures and hence finds use in a number of applications as for example near net shaped parts from otherwise brittle material.

In all of the aforementioned embodiments, the heating step (annealing) should preferably be done in a reducing atmosphere or in a neutral oxygen free atmosphere. Such an atmosphere can be provided by nitrogen, hydrogen or argon. By annealing the consolidated part in a reducing atmosphere, the production of iron oxide is prevented.

The invention further includes ferrous (iron or steel parts) made by the aforementioned process. Specifically, the invention is directed to an iron or steel part comprised of a substantially homogeneous shaped mass of compacted ductile metal coated ferrous particles having said coating diffused therein. The diffusion of the coating into the ferrous material being the result of heating the compacted coated ferrous particles at a sufficient temperature and for a sufficient time period to solubilize the metal coating into the ferrous particles. Examples of such parts include steel sprockets and steel gears.

The invention is further directed to ferrous particulate materials comprising a ferrous particle having a substantially uniform ductile metallurgical coating disposed thereon. The coating is from about 1% by weight to about 50% by weight and is preferably chosen from the metals set forth above for coating ferrous particles in connection with the present methods for making ferrous parts.

EXAMPLES

Example 1

Three hundred (300) grams of 99.9% iron powder (Hoeganes 1000C) are coated with a layer of zinc by plating the powders with 10 wt. % zinc. The coated powders are charged into the 1.23 cm die of a 50 ton hydraulic press (Dake 50H) and pressed at intervals of increasingly higher pressures from 20 Ksi to 250 Ksi. The part being pressed is removed from the die and the density is measured. The density of the pressed part is plotted as a function of pressure over time and the results are reported in FIG. 1.

Three hundred grams of pure uncoated iron powder (Hoeganes 1000C) are charged into the die of the same 50 ton hydraulic press as above and pressed in accordance with the process outlined immediately above for coated iron powder. The density of the pressed part is plotted as a function of pressure over time and the resultant curve is shown in FIG. 1.

Example 2

Three hundred (300) grams of M2 steel powder are coated with a layer of cobalt by electroplating the powders from a fluidized bed with 13.9 wt. % cobalt. Each of three 20-gram samples (A, B, and C) of the coated powders are charged into the ⅜ inch in diameter by ½ inch high cylindrical shaped die of a 50 ton hydraulic press (Dake 50H) and pressed at from 200 Ksi to 250 Ksi. The parts are subsequently removed from the die and heat treated at a temperature of about 500° C. for one hour to diffuse the cobalt into the steel. The cylindrical steel samples are then heated to a temperature of 1500° F. (pre-soak) and then heated at 2150° F. for five minutes. The samples are then quenched in nitrogen at 3 atmospheres and double tempered at 1000° F. The density and Rockwell hardness (Rockwell C scale) of each of the samples are measured and the results are as follows in Table I.

TABLE I

| Sample | A | B | C |
|---|---|---|---|
| Hardness | 54.2 | 54.4 | 54.0 |
| Density | 7.768 | 7.768 | 7.768 |

What is claimed is:

1. A method for making a part from particulates of ferrous material comprising the steps of:

providing a quantity of particulate ferrous material;

electroplating a metallurgical layer of from greater than about 0 wt % to about 50 wt % of ductile metal or alloy onto each of said particulates to produce coated particulates;

consolidating the coated particulates in the shape of a part to make a part having a green density greater than that of a part made by consolidating the particulate ferrous material;

heating said part at a sufficient temperature for a sufficient time to diffuse said metallurgical layer of metal or alloy into the particulate ferrous material, said temperature being less than the sintering temperature of said ferrous material, said temperature being less than the sintering temperature of said ferrous material.

2. The method according to claim 1, wherein the ferrous material is selected from the group consisting of iron, and steel.

3. The method according to claim 1, wherein the ductile metal or alloy is selected from the group consisting of cobalt, nickel, zinc, antimony and tin-zinc alloys.

4. The method according to claim 1, wherein the wt. % of the plating is less than 2 wt. %.

5. The method according to claim 1, wherein the consolidation step is done in a die of a powder press.

6. The method according to claim 1 wherein particulates of cobalt and nickel based materials are used in place of the particulates of ferrous material.

7. A method for increasing the density of parts made by pressing powders of material that work hardens rapidly, comprising the steps of:

providing a quantity of a ferrous powder of a material that work hardens;

coating a layer of ductile metal onto each piece of the powder;

consolidating said coated powdered materials with pressure to form a fully dense part; and heating said part at a sufficient temperature and for a sufficient time period to cause the coating material to solubilize into the ferrous powder.

8. A method for engineering the properties of a part comprising the steps of:

providing a quantity of particulate material; plating a layer of from about 2 wt. % to about 50 wt. % of a second material onto the surface of each particulate; consolidating the plated particulate material to form a part; and heating the part at a temperature of from about 350° C. to about 750° C., for a time period of from about 10 minutes to about 120 minutes to produce a final part by diffusing the plating layer into the particulate material.

9. The method according to claim 8, wherein the first material is selected from the group consisting of steel and iron.

10. The method according to claim 8, wherein the second material is selected from the group consisting of cobalt, nickel, copper, zinc or tin-zinc alloy.

11. The method according to claim 9, wherein the first material is steel and the second material is cobalt.

12. The method according to claim 11, wherein the temperature and time period of the heating step is selected to cause the final part to exhibit tensile strength of steel and mechanical properties of cobalt and the temperature is from about 350° C. to about 800° C. and the time period is from about 10 minutes to about 120 minutes.

13. A method for producing a steel part having a case hardened surface comprising the steps of:

providing a quantity of coated iron particles;

consolidating said particles to form a part;

heating said part at a temperature of from about 400° C. to about 600° C. for a period of time of from about 120 minutes to about 500 minutes to diffuse the coating into said iron particles;

exposing said part to an elevated temperature of from about 700° C. to about 1400° C. for a period of from about 1 hour to about 4 hours, said exposing being done in a carbon gas atmosphere, thereby hardening the case of said part;

quenching said case hardened part in oil.

* * * * *